US008262865B2

(12) United States Patent
Sharma et al.

(10) Patent No.: US 8,262,865 B2
(45) Date of Patent: Sep. 11, 2012

(54) OPTIMIZING HEAVY OIL RECOVERY PROCESSES USING ELECTROSTATIC DESALTERS

(75) Inventors: Arun K. Sharma, Missouri City, TX (US); Michael F. Raterman, Doylestown, PA (US)

(73) Assignee: ExxonMobil Upstream Research Company, Houston, TX (US)

( * ) Notice: Subject to any disclaimer, the term of this patent is extended or adjusted under 35 U.S.C. 154(b) by 545 days.

(21) Appl. No.: 12/464,724

(22) Filed: May 12, 2009

(65) Prior Publication Data

US 2009/0321323 A1 Dec. 31, 2009

Related U.S. Application Data

(60) Provisional application No. 61/133,270, filed on Jun. 27, 2008.

(51) Int. Cl.
*C10C 3/08* (2006.01)

(52) U.S. Cl. ..... 196/14.52

(58) Field of Classification Search ..... 196/14.52
See application file for complete search history.

(56) References Cited

U.S. PATENT DOCUMENTS

| | | | | |
|---|---|---|---|---|
| 4,226,689 | A | 10/1980 | Mayse et al. | |
| 4,226,690 | A | 10/1980 | Martin | |
| 4,385,982 | A * | 5/1983 | Anderson | 208/390 |
| 4,702,815 | A | 10/1987 | Prestridge et al. | |
| 5,219,471 | A | 6/1993 | Goyal et al. | |
| 5,236,577 | A | 8/1993 | Tipman et al. | |
| 5,871,634 | A | 2/1999 | Wiehe et al. | |
| 5,997,723 | A | 12/1999 | Wiehe et al. | |
| 6,210,560 | B1 | 4/2001 | Wiehe et al. | |
| 6,214,213 | B1 | 4/2001 | Tipman et al. | |
| 6,355,159 | B1 | 3/2002 | Myers et al. | |
| 6,860,979 | B2 | 3/2005 | Sams | |
| 7,351,320 | B2 | 4/2008 | Sams | |
| 2007/0111903 | A1 | 5/2007 | Engel et al. | |

FOREIGN PATENT DOCUMENTS

| | | | |
|---|---|---|---|
| CA | 2 502 329 | A1 | 9/2006 |
| GB | 2 084 179 | A | 4/1982 |
| GB | 2084179 | A * | 4/1982 |
| GB | 2 419 305 | A | 4/2006 |
| WO | WO 2007/102819 | A1 | 9/2007 |

OTHER PUBLICATIONS

Sams, G. W. et al.,"New Methods of Application of Electrostatic Fields", AIChE Spring National Meeting, Apr. 2004, 16 pages, New Orleans, LA.

Thomason, William H. et al., "Advanced Electrostatic Technologies for Dehydration of Heavy Oils", SPE/PS-CIM/CHOA 97786, 2005 SPE International Thermal Operations and Heavy Oil Symposium, Nov. 1-3, 2005, pp. 1-7, Calgary, AB, Canada.

* cited by examiner

*Primary Examiner* — Randy Boyer
(74) *Attorney, Agent, or Firm* — ExxonMobil Upstream Research Company-Law Department

(57) ABSTRACT

The invention relates to improved bitumen recovery processes and systems. The process may include providing a bitumen froth feed stream, separating the stream in a froth separation unit to produce a diluted bitumen stream, treating the diluted bitumen stream in an electrostatic desalter to produce a treated bitumen stream, and separating the treated bitumen stream into a solvent recycle stream and a bitumen product stream. The system may include a combined AC/DC desalter with a control unit for optimizing the treatment process to produce a product bitumen stream using less solvent and smaller separators than conventional bitumen froth treatment plants and processes.

10 Claims, 5 Drawing Sheets

OPTIMIZING HEAVY OIL RECOVERY PROCESSES USING ELECTROSTATIC DESALTERS

CROSS REFERENCE TO RELATED APPLICATION

This application claims the benefit of U.S. Provisional Application No. 61/133,270, filed Jun. 27, 2008.

FIELD OF THE INVENTION

The present invention relates generally to producing hydrocarbons. More specifically, the invention relates to methods and systems for upgrading bitumen in a solvent based froth treatment process using electrostatic desalting for optimization of the process.

BACKGROUND OF THE INVENTION

The economic recovery and utilization of heavy hydrocarbons, including bitumen, is one of the world's toughest energy challenges. The demand for heavy crudes such as those extracted from oil sands has increased significantly in order to replace the dwindling reserves of conventional crude. These heavy hydrocarbons, however, are typically located in geographical regions far removed from existing refineries. Consequently, the heavy hydrocarbons are often transported via pipelines to the refineries. In order to transport the heavy crudes in pipelines they must meet pipeline quality specifications.

The extraction of bitumen from mined oil sands involves the liberation and separation of the bitumen from the associated sands in a form that is suitable for further processing to produce a marketable product. Among several processes for bitumen extraction, the Clark Hot Water Extraction (CHWE) process represents an exemplary well-developed commercial recovery technique. In the CHWE process, mined oil sands are mixed with hot water to create slurry suitable for extraction as bitumen froth.

After extraction, the heavy oil slurry (e.g. bitumen froth) may be subjected to a paraffinic froth treatment process. In such a process, the slurry or froth may be introduced into a froth separation unit (FSU) wherein the froth is separated into a diluted bitumen stream and a tailings stream. The diluted bitumen stream may be directed to a solvent recovery unit (SRU) for flashing or other processing to produce a hot bitumen product stream and a solvent stream. The hot bitumen product stream may be sent to a pipeline for production and the solvent stream may be recycled in the treatment process.

Electrostatic desalters/dehydrators have been utilized in the oil field and at refineries for the purpose of removing contaminants in the oil being processed. This generally results in reduced corrosion and fouling, control of trace metal content, and improved wastewater treatment. See, e.g. Sams, Gary W. and Warren, Kenneth W., *New Methods of Application of Electrostatic Fields*, AIChE Spring National Meeting, New Orleans, La., April 2004. Such units may be used in a variety of configurations. See, e.g. U.S. Pat. No. 6,860,979. Electrostatic desalters may also be used to treat heavy oils. See, e.g. Thomason, William H., et al, *Advanced Electrostatic Technologies for Dehydration of Heavy Oils*, SPE 97786, November 2005.

Methods to optimize the efficiency of settlers can significantly impact the efficiency of heavy hydrocarbon (e.g. bitumen) recovery processes. There exists a need in the art for a low cost method to produce pipeline quality hydrocarbons from heavy oil or bitumen.

SUMMARY OF THE INVENTION

In one aspect of the invention, a system of recovering hydrocarbons is provided. The system includes a bitumen froth inlet stream including bitumen, water, solids, and at least one paraffinic solvent; a froth separation unit configured to receive the bitumen froth inlet stream and produce at least a diluted bitumen stream and a first tailings stream; a solvent recovery unit configured to receive the diluted bitumen stream and produce a product bitumen stream and a solvent recycle stream; and at least one electrostatic desalter configured to receive at least one of the diluted bitumen stream and the product bitumen stream and produce a treated bitumen stream. The system may also include a second froth separation unit to produce a second diluted bitumen stream to the electrostatic desalter and a control unit for optimize operation of the desalter in the system.

In another aspect of the invention, a method for recovering hydrocarbons is provided. The method includes providing a bitumen froth inlet stream including a volume of paraffinic solvents, a volume of water, and asphaltenes; settling out at least a portion of the asphaltenes in a froth separation unit to produce at least a first settled out asphaltenes stream (a first tailings stream) and a diluted bitumen stream; separating the volume of paraffinic solvents from the diluted bitumen stream in a solvent recovery unit configured to produce a product bitumen stream and a solvent recycle stream; and treating at least one of the diluted bitumen stream and the product bitumen stream in at least one electrostatic desalter to produce a treated bitumen stream. The method may further include providing a second diluted bitumen stream to the desalter from a second froth separation unit and may also include controlling certain process conditions to optimize the performance of the desalter in the process.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

Figure 1:
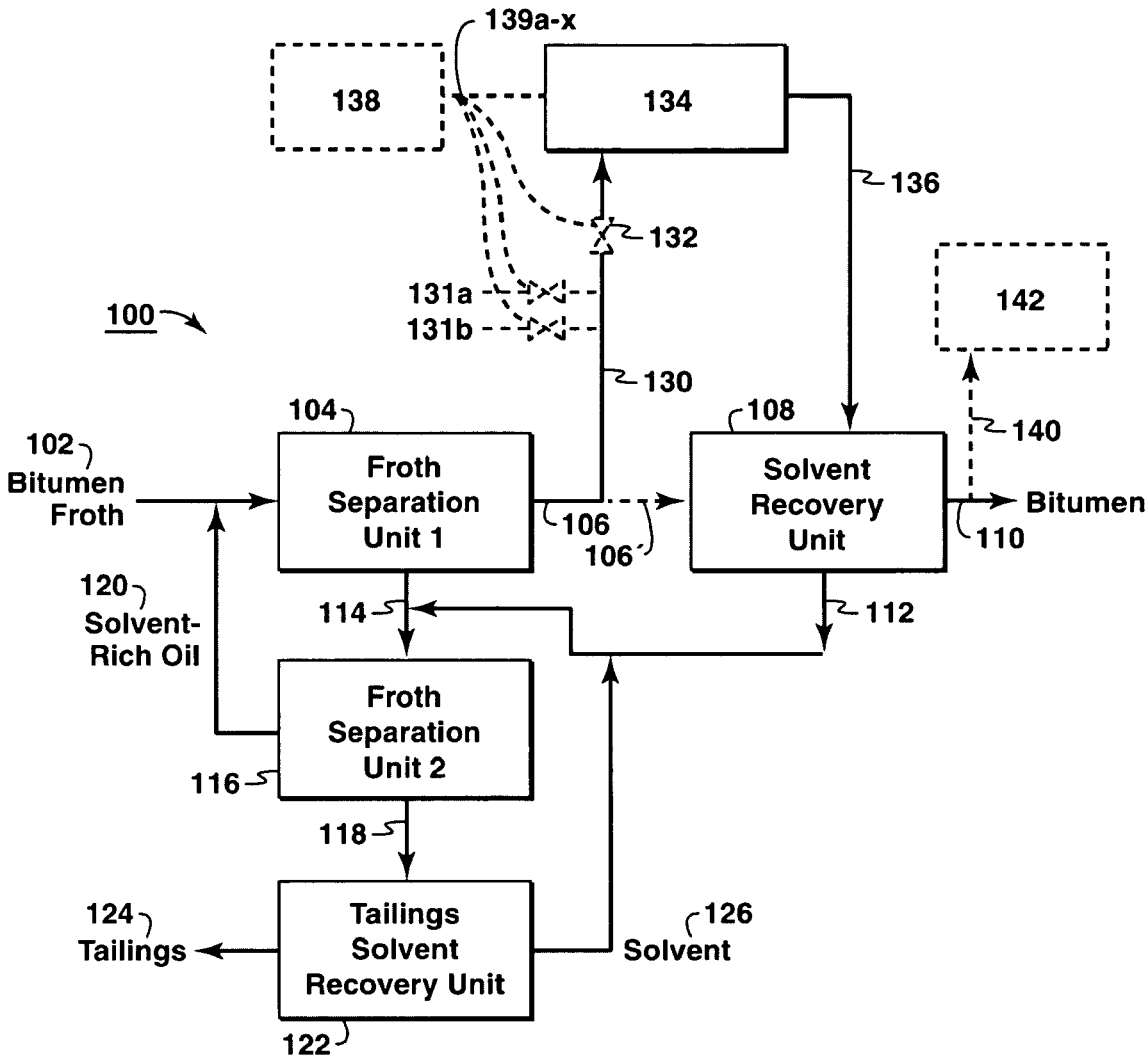
FIG. 1 is a schematic of a heavy hydrocarbon treatment plant layout according to at least one aspect of the present disclosure.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

The term "asphaltenes" as used herein refers to hydrocarbons which are the n-heptane insoluble, toluene soluble component of a carbonaceous material such as crude oil, bitumen or coal. One practical test to determine if oil is an asphaltene is to test whether the oil is soluble when blended with 40 volumes of toluene but insoluble when the oil is blended with 40 volumes of n-heptane. If so, the oil may be considered an asphaltene. Asphaltenes are typically primarily comprised of carbon, hydrogen, nitrogen, oxygen, and sulfur as well as trace amounts of vanadium and nickel. The carbon to hydrogen ratio is generally about 1:1.2, depending on the source.

The term "bitumen" as used herein refers to heavy oil. In its natural state as oil sands, bitumen generally includes asphaltenes and fine solids such as mineral solids.

The invention relates to processes and systems for recovering hydrocarbons. In one aspect, the invention relates to a system for recovering hydrocarbons. The system may include a plant located at or near a bitumen (e.g. heavy hydrocarbon) mining or recovery site or zone. The plant may include at least one froth separation unit (FSU) having a bitumen froth inlet for receiving bitumen froth (or a solvent froth-treated bitumen mixture) and a diluted bitumen outlet for sending diluted bitumen from the FSU. The plant also includes a solvent recovery unit for separating bitumen from solvent to produce a solvent recycle stream and a bitumen product stream. The plant further includes at least one electrostatic desalter configured to treat either or both of the diluted bitumen stream and the bitumen product stream. Where the desalter is configured to treat the diluted bitumen stream, the SRU will be configured to separate the treated bitumen stream. The plant may also include at least one tailings solvent recovery unit (TSRU), solvent storage unit, pumps, compressors, and other equipment for treating and handling the heavy hydrocarbons and byproducts of the recovery system.

In another aspect, the invention is a process to partially upgrade a bitumen or heavy crude and is particularly suited for bitumen froth generated from oil sands which contain bitumen, water, and asphaltenes. The process includes providing a bitumen froth inlet stream having asphaltenes, paraffinic solvents, and water, settling out at least some of the asphaltenes in a froth separation unit (FSU) to produce a diluted bitumen stream and a tailings stream, separating the solvents from the diluted bitumen stream in a solvent recovery unit (SRU) to produce a bitumen product stream and a solvent recycle stream, and treating either or both of the diluted bitumen stream and the bitumen product stream in an electrostatic desalter to produce a treated bitumen stream. In the case where the treatment is of the diluted bitumen stream, the separation step separates the treated bitumen stream rather than the diluted bitumen stream.

Referring now to the figures, FIG. 1 is a schematic of an exemplary paraffinic froth treatment system including certain aspects of the present disclosure. The plant 100 receives bitumen froth 102 from a heavy hydrocarbon recovery process. The bitumen froth 102 includes bitumen, water, and at least one paraffinic solvent and is fed into a first froth separation unit (FSU) 104. A diluted bitumen stream 106 and a tailings stream 114 are produced from the FSU 104. The diluted bitumen stream 106 may be wholly or partly diverted to an electrostatic desalter 134 via stream 130. The desalter 134 produces a treated bitumen stream 136, which is sent to a solvent recovery unit (SRU) 108, which separates bitumen from solvent to produce a bitumen product stream 110 and a solvent recycle stream 112. If a portion of the diluted bitumen stream 106 is not diverted, then it may be delivered to the SRU 108 via stream 106' without treatment in the desalter 134. In one optional embodiment, the bitumen product stream 110 is sent to an electrostatic desalter 142 via line 140 for treatment. Treatment in the desalter 142 may be in addition to or in lieu of treatment in desalter 134. Further, desalter 134 may be the same unit as desalter 142 in some embodiments. Note that the SRU 108 may be configured to separate solvent from the diluted bitumen stream 106 or the treated bitumen stream 136, depending on the location of the desalter 134 or 142.

In one exemplary embodiment of the present invention, the desalters 134 and 142 include a fresh water inlet stream 131*a* having a control valve and a chemical inlet stream 131*b* with a control valve (only shown on desalter 134). The streams are connected to the diluted bitumen stream 130 for addition to stream 130. The desalters 134 and 142 also preferably include a mixing valve or other such device 132 for mixing the diluted bitumen stream 130 with either or both of the fresh water inlet stream 131*a* and the chemical inlet stream 131*b*. This exemplary embodiment may further include a control unit 138 having input/output lines 139*a*-139*x* for obtaining data from sensors in the system 100 and sending control signals to various parts of the plant 100. The control unit 138 is preferably an automated unit, but may include some manual operability such as a manual override, or be completely manually operated. This exemplary embodiment may further include a heating unit to raise the temperature of the diluted bitumen stream 130 (or product bitumen stream 110) to at least about 115 degrees Celsius (° C.) up to about 150° C.

The control unit is configured to receive at least one data input and modify at least one process condition to optimize a composition of the treated bitumen stream 136. The data input may be one or more of the following: a flow rate of the diluted bitumen stream, a flow rate of the fresh water inlet stream, a flow rate of the chemical inlet stream, a composition of the diluted bitumen stream, a composition of chemicals flowing through the chemical inlet, an electrostatic field characteristic, a temperature inside the electrostatic desalter, a mixing valve pressure, mixing valve intensity, a temperature of the diluted bitumen stream, a thickness of an emulsion layer, and any combination thereof. The process condition may be one or more of: the flow rate of the diluted bitumen stream, the flow rate of the fresh water inlet stream, the flow rate of the chemical inlet stream, a solvent content of the diluted bitumen stream, the composition of chemicals flowing through the chemical inlet, the electrostatic field characteristic, the temperature inside the electrostatic desalter, the mixing valve pressure, the mixing valve intensity, the temperature of the diluted bitumen stream, the thickness of an emulsion layer, and any combination thereof.

In another embodiment, the desalters 134 and 142 may be configured as multiple desalting units. The desalting units 134 and 142 may be arranged as a multi-stage train such as a two stage train, or may be operated in parallel, such as by having two parallel single-stage units. Any number of units may be used, which will depend on cost, availability, desired capacity and other operational factors that are best addressed by a person of ordinary skill in the art on a case-by-case basis.

In an exemplary embodiment of the plant 100, the bitumen froth 102 may be mixed with a solvent-rich oil stream 120 from FSU 116 in FSU 104. Additionally, the solvent recycle stream 112 may be mixed with tailings 114 from the first FSU 104 and fed into a second froth separation unit 116. The second FSU 116 produces a solvent rich oil stream 120 and a second tailings stream 118. The solvent rich oil stream 120 is mixed with the incoming bitumen froth 102 and the tailings stream is sent to a tailings solvent recovery unit 122, which produces a third tailings stream 124 and a solvent stream 126. In a conventional paraffinic froth treatment (PFT) plant, the temperature of FSU 104 may be maintained at about 60 to 80 degrees Celsius (° C.), or about 70° C. and the target solvent to bitumen ratio of such prior art systems is about 1.4:1 to 2.2:1 by weight or about 1.6:1 by volume on average. In the disclosed plant 100, the target solvent to bitumen ratio is reduced by 10 to 50% from those listed above. This ratio will vary depending on the solids concentration in the bitumen, types of solvents used, composition of the bitumen, and other factors. However, it is expected that the desalters 134 or 142 are expected to reduce the solids concentration (in parts per million) by about half. This solvent reduction makes operation of the plant 100 more cost efficient, permits utilization of smaller FSU's 104 and 116, and a smaller SRU 108 to treat an equivalent amount of produced bitumen.

The bottom stream 114 from FSU 104 is the tailings substantially comprising water, mineral solids, asphaltenes, and some residual bitumen. The residual bitumen from this bottom stream is further extracted in FSU 116 by contacting it with fresh solvent (from e.g. 112 or 126). The bottom stream 114 of the plant 100 has a lower flow rate than the bottom stream of a conventional PFT plant and the solvent to bitumen ratio is also lower. In addition, FSU 116 may be smaller relative to the amount of bitumen recovered in stream 102.

The solvent-rich overflow 120 from FSU 116 may be mixed with the bitumen froth feed 102. The bottom stream 118 from FSU 116 is the tailings substantially comprising solids, water, asphaltenes, and residual solvent. The bottom stream 118 is fed into a tailings solvent recovery unit (TSRU) 122, a series of TSRUs or by another recovery method. In the TSRU 122, residual solvent is recovered and recycled in stream 126 prior to the disposal of the tailings in the tailings ponds (not shown) via a tailings flow line 124. Exemplary operating pressures of FSU 104 and FSU 116 are respectively about 550 thousand Pascals gauge (kPag) and about 600 kPag mixed pentane solvents. Other solvents may require a higher pressure to prevent boiling or allow for operation at lower pressures. FSUs 104 and 116 are typically made of carbon-steel but may be made of other materials.

Figure 2:
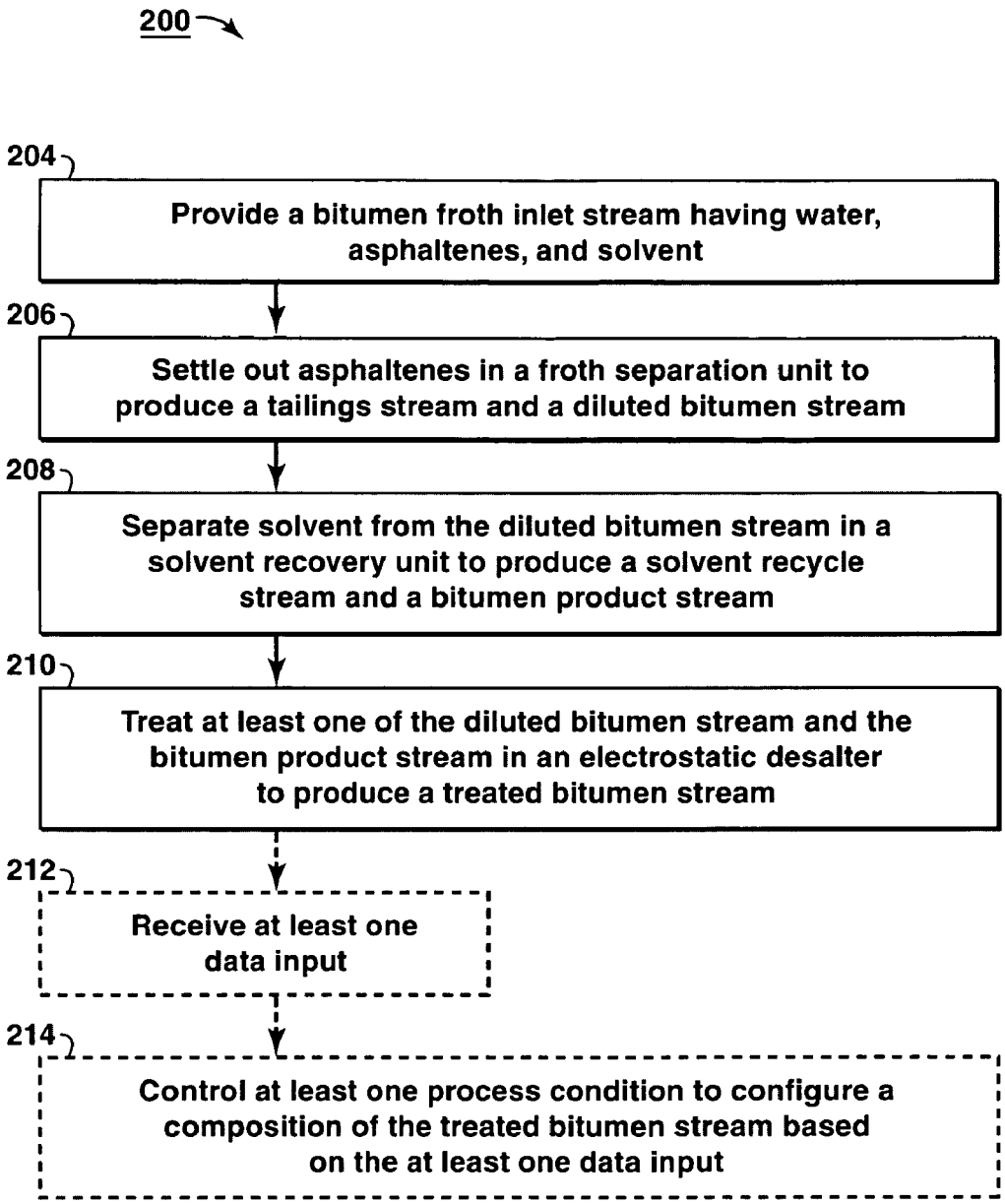
FIG. 2 is a flow chart of an exemplary heavy hydrocarbon treatment process including at least one aspect of the present disclosure.

FIG. 2 is an exemplary flow chart of a process for recovering hydrocarbons utilizing at least a portion of the equipment disclosed in FIG. 1. As such, FIG. 2 may be best understood with reference to FIG. 1. The process 200 includes providing a bitumen froth inlet stream having water, asphaltenes, and solvent 204. Next, the asphaltenes are settled out in a froth separation unit (FSU) to produce a tailings stream and a diluted bitumen stream 206. The solvent is separated from the diluted bitumen stream in a solvent recovery unit (SRU) to produce a solvent recycle stream and a bitumen product stream 208. Either or both of the diluted bitumen stream and the bitumen product stream are treated in an electrostatic desalter to produce a treated bitumen stream 210. Note, that certain steps may be repeated and the order of the steps may be altered. For example, the treatment step 210 may come before the separation step 208, after the separation step 208, or both. In the case where the treatment step 210 comes prior to the separation step 208, the SRU separates the treated bitumen stream rather than the diluted bitumen stream. Optionally, the process 200 may include receiving at least one data input 212 and controlling at least one process condition to configure a composition of the treated bitumen stream bas on the data input 214.

Still referring to FIGS. 1 and 2, the step of providing the bitumen froth 204 may include a thermal extraction method such as the clark hot water extraction (CHWE) method, steam assisted gravity drainage (SAGD), vapor extraction (VAPEX), sliding reservoir bitumen recovery (SRBR), fluidized, in-situ, reservoir extraction (FIRE), cold, heavy oil production (CHOPS) or some combination of these methods. An exemplary composition of the resulting bitumen froth 102 is about 60 wt % bitumen, 30 wt % water and 10 wt % solids, with some variations to account for the extraction processing conditions. In such an extraction process oil sands are mined, bitumen is extracted from the sands using water (e.g. the CHWE process or a cold water extraction process), and the bitumen is separated as a froth comprising bitumen, water, solids and air. During extraction, air is added to the bitumen/water/sand slurry to help separate bitumen from sand, clay and other mineral matter. The bitumen attaches to the air bubbles and rises to the top of the separator (not shown) to form a bitumen-rich froth 102 while the sand and other large particles settle to the bottom. Regardless of the type of oil sand extraction process employed, the extraction process will typically result in the production of a bitumen froth product stream 102 comprising bitumen, water and fine solids (including asphaltenes, mineral solids) and a tailings stream 114 consisting essentially of water and mineral solids and some fine solids.

In the process 200 solvent 120 is added to the bitumen-froth 102 after extraction and the mixture is pumped to another separation vessel (froth separation unit or FSU 104). The addition of solvent 120 helps remove the remaining fine solids and water. Put another way, solvent addition increases the settling rate of the fine solids and water out of the bitumen mixture. Because of the treatment step 210 of the present process 200, less solvent is used and fewer asphaltenes and other solids are settled out of the bitumen mixture. The treatment step 210 removes many of these solids in addition to dehydrating the bitumen stream, removing salts, and other impurities. In one embodiment of the recovery process 200 a paraffinic solvent is used to dilute the bitumen froth 102 before separating the product bitumen by gravity in a device such as FSU 104. Where a paraffinic solvent is used (e.g. when the weight ratio of solvent to bitumen is greater than 0.8), a portion of the asphaltenes in the bitumen are rejected thus achieving solid and water levels that are lower than those in existing naphtha-based froth treatment (NFT) processes. In the NFT process, naphtha may also be used to dilute the bitumen froth 102 before separating the diluted bitumen by centrifugation (not shown), but not meeting pipeline quality specifications.

As would be expected with any process, the preferred conditions seek to produce the greatest amount of bitumen product 110 with the least amount of expense (e.g. from energy use, chemical use, etc.). Variables that could be configured include, but are not limited to: flow rate of the diluted bitumen stream, flow rate of the fresh water inlet stream, flow rate of the chemical inlet stream, solvent content of the diluted bitumen stream, composition of chemicals flowing through the chemical inlet, electrostatic field characteristics, temperature inside the electrostatic desalter, mixing valve pressure, mixing valve intensity, temperature of the diluted bitumen stream, thickness of an emulsion layer, and any combination thereof. Configuring the preferred conditions may be accomplished by obtaining data 212 related to the process 200 and controlling process steps 214 like those listed above via manual or automated control systems such as controller 138.

Figure 3:
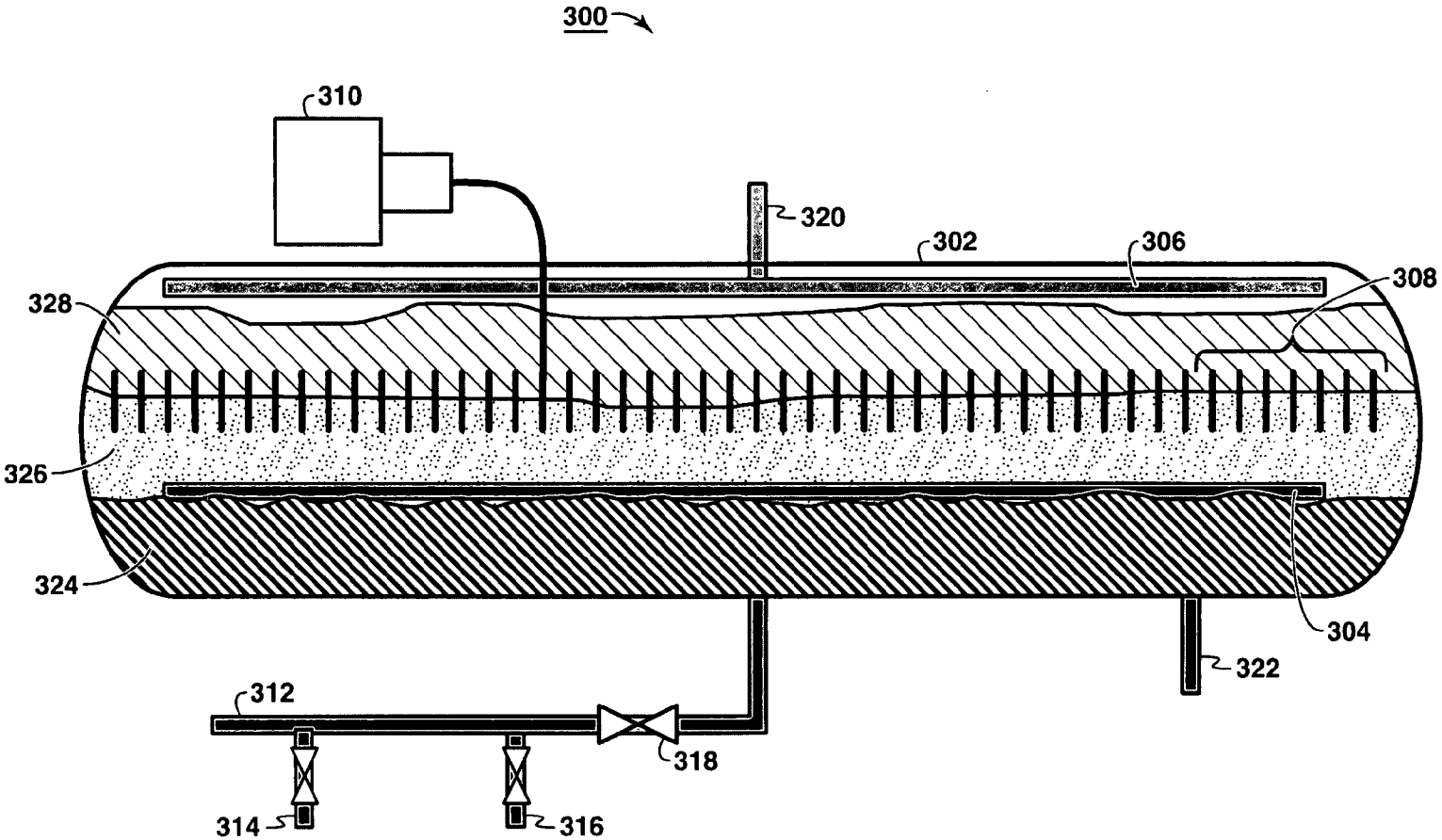
FIG. 3 is an illustration of an exemplary electrostatic desalting unit for use in the plant of FIG. 1 and/or the process of FIG. 2.

FIG. 3 is an exemplary illustration of an electrostatic desalting unit for use in the plant of FIG. 1 and/or the process of FIG. 2. As such, FIG. 3 may be best understood with reference to FIGS. 1 and 2. The desalting unit 300 may include a tank 302, an inlet distributor (also called a spreader) 304, an oil collector 306, electrodes 308, and a power unit 310 operatively connected to the electrodes 308. In addition, the desalter 300 includes an inlet flow line 312, a chemical injection line 314, fresh water injection line 316, a mixing valve 318, and oil outlet 320 operatively attached to the oil collector 306, and a water outlet 322. During standard operation, the desalter 300 may contain at least three layers of fluids: a water layer 324 at the bottom, an emulsion layer 326 above that, and an oil layer 328 on top of the emulsion layer 326. In addition, when treating heavy oil having particulates such as mineral solids and asphaltenes, the solids may settle at the bottom of the tank. The desalting unit 300 may be either of the desalters 130 or 142 and may be utilized in parallel with other desalting units or may be configured in stages with other units.

Although all types of electrostatic desalters are within the scope of the present disclosure, one preferred type of electrostatic desalter 300 utilizes a combined alternating current (AC)/direct current (DC) field. Depending on the composition of the bitumen feed 102, it may be preferable to utilize a modulated high voltage DC field with AC (MHVDC/AC) type of desalter, bi-modal field modulation (BFM) type of desalter, or another type. See, e.g. SPE 97786, supra, which is hereby incorporated by reference for further description of these desalter types. The basic electrode 308 configuration is the same for all of these types of desalters.

In operation, the desalter 300 mixes the feed stream 312 and/or 130 with fresh "wash water" 314 and/or 131*a* and a chemical agent 316 and/or 131*b*. The combined stream is then mixed in the valve mixer 318 and/or 132 to form an emulsion. In general, the AC field is established between the bottom of the electrodes 308 and the oil/water interface and promotes initial water droplet coalescence. The DC field is generated between each pair of oppositely charged electrodes 308 establishing an electrostatic voltage field between the electrodes 308. This field is a significant factor in the dipole force, electrophoretic force, and the di-electrophoretic force, which are often referred to as "coalescence forces," which directly affect the amount of separation of water from oil droplets.

Some exemplary factors that affect desalter operation and performance include the feed rate and quality of the feed composition, temperature/viscosity/density relationships, electrical field intensity, wash water rate and quality, flow configuration, emulsion formation (e.g. by pumps, exchangers, valves, and mixers, etc.), control of water level and emulsion layers, demulsifier chemicals addition rate, and others. Treatment of heavy oils having asphaltenes and mineral solids provide additional challenges and may require specific solutions such as increasing the temperature of the desalter to lower the viscosity of the heavy hydrocarbon, increasing the amount of chemical demulsifier to destabilize the solids-stabilized emulsion, and enhanced degassing techniques. Also, sludge drains and mud washing techniques may be utilized to prevent accumulation of solids in the desalter tank 304. Another optional feature is the use of a highly sensitive level probe to sense the water content of the oil/water interface layer. These and other factors and techniques are discussed in greater detail in Warren, Kenneth W. and Armstrong, John, *Desalting Heavy Crude Oils—The Venezuelan Experience*, found at: natcogroup.com under Technical Papers, December 2001, which is hereby incorporated by reference for said technical disclosures.

Figure 4:
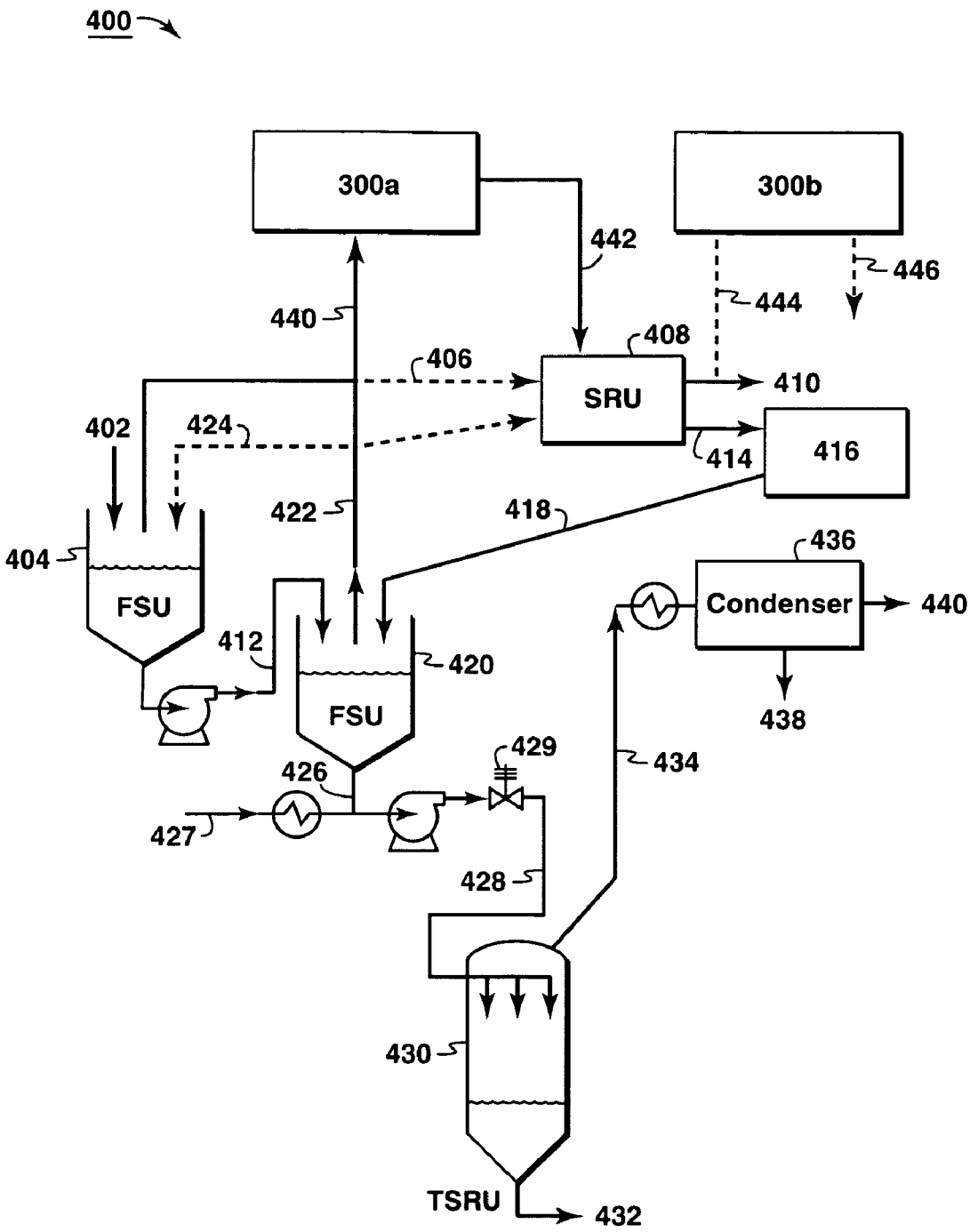
FIG. 4 is a schematic of an alternative exemplary bitumen froth treatment plant layout including at least one aspect of the present disclosure.

FIG. 4 is an exemplary schematic of an alternative bitumen froth treatment plant of FIG. 1 utilizing the process of FIG. 2, including the desalter of FIG. 3. As such, FIG. 4 may be best understood with reference to FIGS. 1-3. The plant 400 includes a bitumen froth input stream 402 (which may also be mixed with a solvent-rich stream 424) is input to a froth separation unit (FSU) 404, which separates stream 402 into a diluted bitumen component 406 comprising bitumen and solvent and a froth treatment tailings component 412 substantially comprising water, mineral solids, precipitated asphaltenes (and aggregates thereof), solvent, and small amounts of unrecovered bitumen. The tailings stream 412 may be withdrawn from the bottom of FSU 404, which may have a conical shape at the bottom, and sent to a second FSU 420, which produces a second diluted bitumen stream 422 and a second tailings stream 426. The second diluted bitumen stream 422 may be combined with the first diluted bitumen stream 406, with the bitumen feed stream 402, or sent directly to the SRU 408. In the preferred case where at least a portion of the second diluted bitumen stream 422 is combined with the first diluted bitumen stream 406, the combined stream is sent via line 440 to an electrostatic desalter 300*a* for treatment before going to the SRU 408 for separation via line 442. In one alternative embodiment, the product stream 410 may be at least partially diverted to an electrostatic desalter 300*b* via line 444 then produced via line 446.

The SRU 408 may be a conventional fractionation vessel or other suitable apparatus in association with other suitable equipment for this purpose in which the solvent 414 is flashed off and condensed in a condenser 416 associated with the solvent flashing apparatus and recycled/reused in the process 400. The solvent free bitumen product 410 is then stored or transported for further processing (e.g. via pipeline) in a manner well known in the art or sent to the electrostatic desalter 300*b*. Froth treatment tailings component 412 may be passed directly to the tailings solvent recovery unit (TSRU) 430 or may first be passed to a second FSU 420.

In one embodiment, FSU 404 operates at a temperature of about 60° C. to about 80° C., or about 70° C. In one embodiment, FSU 404 operates at a pressure of about 700 to about 900 kPa, or about 800 kPa. Diluted tailings component 412 may typically comprise approximately 50 to 70 wt % water, 15 to 30 wt % mineral solids, and 5 to 25 wt % hydrocarbons. The hydrocarbons comprise asphaltenes (for example 2.0 to 12 wt % or 9 wt % of the tailings), bitumen (for example about 7.0 wt % of the tailings), and solvent (for example about 8.0 wt % of the tailings). In additional embodiments, the tailings may comprise greater than 1.0, greater than 2.0, greater than 3.0, greater than 4.0, greater than 5.0, greater than 10.0 wt % asphaltenes, or about 15.0 wt % asphaltenes.

Still referring to FIG. 4, FSU 420 performs generally the same function as FSU 404, but is fed the tailings component 412 rather than a bitumen froth feed 402. The operating temperature of FSU 420 may be higher than that of FSU 404 and may be between about 80° C. and about 100° C., or about 90° C. In one embodiment, FSU 420 operates at a pressure of about 700 to about 900 kPa, or about 800 kPa. A diluted bitumen component stream 422 comprising bitumen and solvent is removed from FSU 420 and is either sent to FSU 404 via feed 424 for use as solvent to induce asphaltene separation, is at least partially diverted to the electrostatic desalter 300*a* via line 440 for treatment, or is passed to SRU 408 via feed 425 or to an another SRU (not shown) for treatment in the same way as the diluted bitumen component 406. The ratio of solvent:bitumen in diluted bitumen component 422 may be, for instance, about 10:1 to 40:1, or about 20:1. Alternatively, diluted bitumen component 422 may be partially passed to FSU 404 via line 424 and partially passed to SRU 408 via line 425, or to another SRU (not shown). Solvent 414 from SRU 408 may be combined with the diluted tailing stream 412 into FSU 420, shown as stream 418, or returned to a solvent storage tank (not shown) from where it is recycled to make the diluted bitumen froth stream 402. Thus, streams 422 and 418 show recycling. In the art, solvent or diluted froth recycling steps are known such as described in U.S. Pat. No. 5,236,577.

In the exemplary system of FIG. 4, the froth treatment tailings 412 or tailings component 426 (with a composition similar to underflow stream 412 but having less bitumen and solvent), may be combined with dilution water 427 to form diluted tailings component 428 and is sent to TSRU 430. Diluted tailings component 428 may be pumped from the FSU 420 or FSU 404 (for a single stage FSU configuration) to TSRU 430 at the same temperature and pressure in FSU 420 or FSU 404. A backpressure control valve 429 may be used before an inlet into TSRU 430 to prevent solvent flashing prematurely in the transfer line between FSU 420 and TSRU 430.

Flashed solvent vapor and steam (together 434) is sent from TSRU 430 to a condenser 436 for condensing both water 438 and solvent 440. Recovered solvent 440 may be reused in the bitumen froth treatment plant 400. Tailings component 432 may be sent directly from TSRU 430 to a tailings storage area (not shown) for future reclamation or sent to a second TSRU (not shown) or other devices for further treatment. Tailings component 432 contains mainly water, asphaltenes, mineral matter, and small amounts of solvent as well as unrecovered bitumen. A third TSRU (not shown) could also be used in series and, in each subsequent stage, the operating pressure may be lower than the previous one to achieve additional solvent recovery. In fact, more than three TSRU's could be used, depending on the quality of bitumen, pipeline specification, size of the units and other operating factors.

Figure 5:
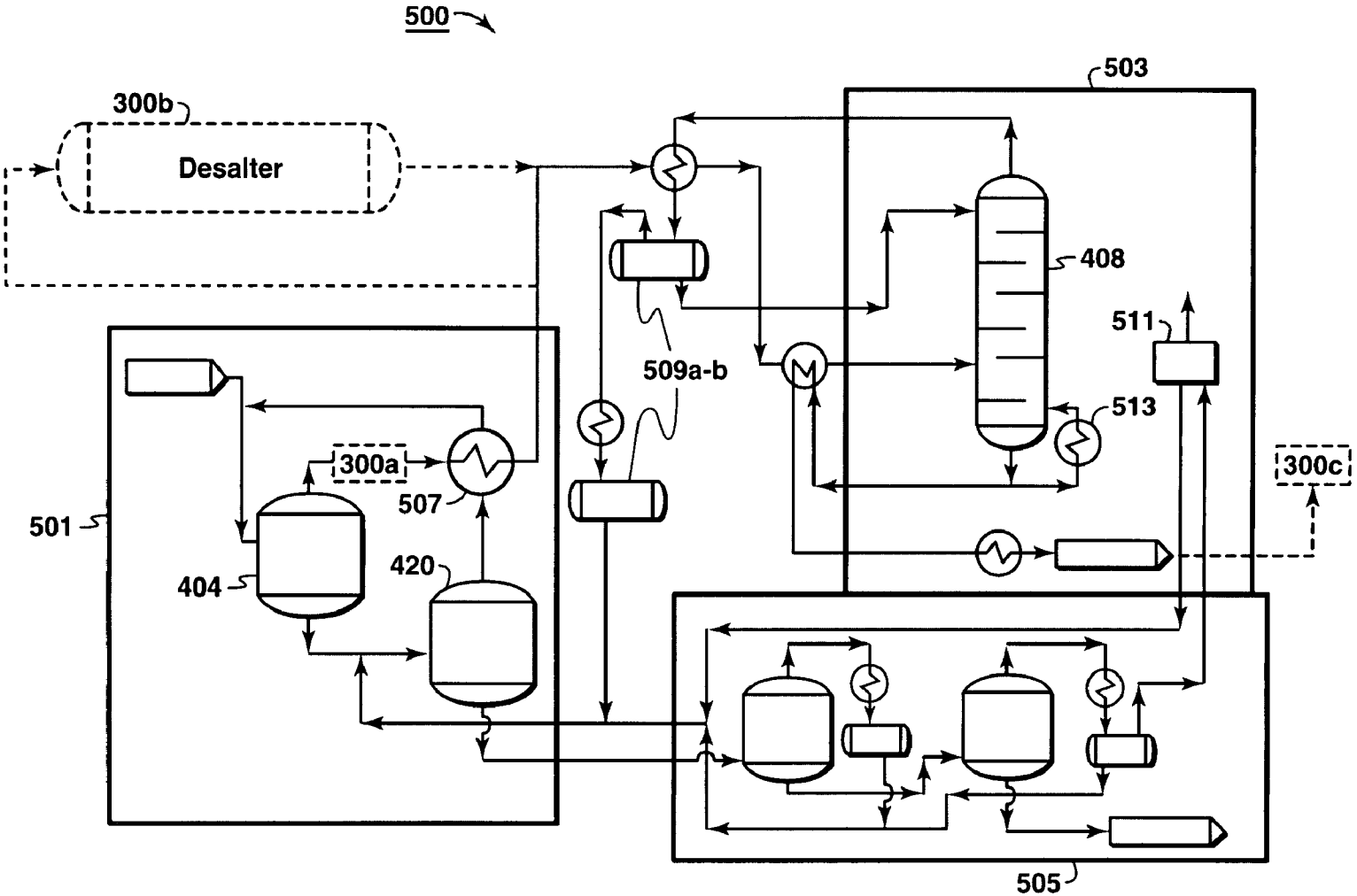
FIG. 5 is a schematic of yet another alternative exemplary bitumen froth treatment plant including at least one aspect of the present disclosure.

FIG. 5 is yet another exemplary alternative embodiment of a heavy oil treatment plant in accordance with the present invention. The plant shares many of the components with the plant of FIG. 4, utilizes the process of FIG. 2, and includes the electrostatic desalter of FIG. 3. as such, FIG. 5 may be best understood with reference to FIGS. 2-4. The plant 500 generally includes three portions, the froth separation portion 501, the solvent recovery portion 503, and the tailings solvent recovery portion 505. Similar to the plant 400, the plant 500 includes at least one desalting unit 300, which may be located in one or all of the locations 300*a*, 300*b*, and 300*c*.

As noted, plant 500 includes many similar components as the plant 400 and to the extent the schematics look the same, they may be considered equivalent. For example, the froth separation portion 501 includes FSU's 404 and 420, but shows a slightly different flow configuration and a heating unit 507. Additional alternative flow schemes are shown between the froth separation portion 501, the solvent recovery portion 503, and the tailings recovery portion 505. These flow lines include additional heaters like 507 as well as separation/accumulation tanks such as 509*a* and 509*b*. The solvent recovery portion 503 includes a solvent recovery unit 408 as well as a vacuum system 511 and a steam generation unit 513. These additional units (e.g. 511 and 513) may also be included in plant 100 and plant 400, but were not shown for simplicity. They are shown in plant 500 for illustrative purposes and as just one example of a layout for a process plant for treating bitumen froth. The plant 500 also more specifically contemplates a high temperature bitumen treatment process.

While the present disclosure may be susceptible to various modifications and alternative forms, the exemplary embodiments discussed above have been shown only by way of example. However, it should again be understood that the disclosure is not intended to be limited to the particular embodiments disclosed herein. Indeed, the present disclosure includes all alternatives, modifications, and equivalents falling within the true spirit and scope of the appended claims.

What is claimed is:

1. A system for recovering hydrocarbons, comprising:

a bitumen froth inlet stream including bitumen, water, solids, and at least one paraffinic solvent;

a froth separation unit configured to receive the bitumen froth inlet stream and produce at least a diluted bitumen stream and a first tailings stream;

a solvent recovery unit configured to receive the diluted bitumen stream and produce a product bitumen stream and a solvent recycle stream; and at least one electrostatic desalter configured to receive at least one of the diluted bitumen stream and the product bitumen stream and produce a treated bitumen stream.

2. The system of claim 1, wherein the electrostatic desalter is configured to remove at least about 10 percent (%) to about 50% of the solids from the at least one of the diluted bitumen stream and the product bitumen stream.

3. The system of claim 1, further comprising a second froth separation unit configured to receive the first tailings stream and produce at least a second diluted bitumen stream and a second tailings stream.

4. The system of claim 3, wherein the electrostatic desalter is configured to receive at least a portion of the second diluted bitumen stream.

5. The system of claim 1, wherein the electrostatic desalter further comprises:

an inlet flow conduit operatively connected to a fresh water inlet configured to deliver a fresh water stream to the inlet flow conduit and a chemical inlet configured to deliver a chemical stream to the inlet flow conduit, wherein the inlet flow conduit is configured to deliver the diluted bitumen stream to the electrostatic desalter;

a mixing valve operatively connected to the inlet flow conduit, wherein the mixing valve is configured to impart mixing energy to the diluted bitumen stream and a second stream selected from the group consisting of the fresh water stream, the chemical stream, and any combination thereof; and an oil outlet configured to produce the treated bitumen stream.

6. The system of claim 5, further comprising a control unit configured to receive at least one data input and modify at least one process condition to configure a composition of the treated bitumen stream.

7. The system of claim 6, wherein the at least one data input is selected from the group comprising: a flow rate of the diluted bitumen stream, a flow rate of the fresh water inlet stream, a flow rate of the chemical inlet stream, a composition of the diluted bitumen stream, a composition of chemicals flowing through the chemical inlet, an electrostatic field characteristic, a temperature inside the electrostatic desalter, a mixing valve pressure, a mixing valve intensity, a temperature of the diluted bitumen stream, a thickness of an emulsion layer, and any combination thereof.

8. The system of claim 7, wherein the at least one process condition is selected from the group comprising: the flow rate of the diluted bitumen stream, the flow rate of the fresh water inlet stream, the flow rate of the chemical inlet stream, a solvent content of the diluted bitumen stream, the composition of chemicals flowing through the chemical inlet, the electrostatic field characteristic, the temperature inside the electrostatic desalter, the mixing valve pressure, the mixing valve intensity, the temperature of the diluted bitumen stream, the thickness of an emulsion layer, and any combination thereof.

9. The system of claim 4, wherein the at least one electrostatic desalter further comprises a plurality of desalting units in a configuration selected from the group consisting of: at least one two-stage train and at least two parallel single-stage units.

10. The system of claim 5, wherein the chemical inlet stream includes a chemical demulsifier.

* * * * *